US008247347B2

(12) United States Patent
Takagi et al.

(10) Patent No.: US 8,247,347 B2
(45) Date of Patent: Aug. 21, 2012

(54) THERMOSENSITIVE RECORDING MEDIUM

(75) Inventors: Ken Takagi, Tokyo (JP); Jun Makihara, Tokyo (JP); Akihito Ogino, Tokyo (JP); Kenji Hirai, Tokyo (JP); Makoto Hasegawa, Iwaki (JP); Shin Suzuki, Iwaki (JP); Takeshi Hirose, Iwaki (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 351 days.

(21) Appl. No.: 12/593,116

(22) PCT Filed: Mar. 14, 2008

(86) PCT No.: PCT/JP2008/054719

§ 371 (c)(1), (2), (4) Date: Sep. 25, 2009

(87) PCT Pub. No.: WO2008/126635

PCT Pub. Date: Oct. 23, 2008

(65) Prior Publication Data

US 2010/0062935 A1 Mar. 11, 2010

(30) Foreign Application Priority Data

Mar. 29, 2007 (JP) ..... 2007-086823

(51) Int. Cl.
*B41M 5/337* (2006.01)
*B41M 5/42* (2006.01)

(52) U.S. Cl. ..... 503/207; 503/226

(58) Field of Classification Search ..... None
See application file for complete search history.

(56) References Cited

U.S. PATENT DOCUMENTS

| | | | | |
|---|---|---|---|---|
| 4,032,690 | A | 6/1977 | Kohmura et al. | |
| 4,243,716 | A | 1/1981 | Kosaka et al. | |
| 4,265,978 | A | 5/1981 | Morishita et al. | |
| 6,037,308 | A | 3/2000 | Sato et al. | |
| 6,656,880 | B2 * | 12/2003 | Aono | 503/207 |
| 6,680,281 | B2 | 1/2004 | Tajiri et al. | |
| 7,618,922 | B2 | 11/2009 | Ogino et al. | |
| 8,129,307 | B2 | 3/2012 | Makihara et al. | |
| 2004/0198603 | A1 | 10/2004 | Kawakami et al. | |
| 2004/0241598 | A1 | 12/2004 | Suga et al. | |
| 2005/0118526 | A1 | 6/2005 | Suga et al. | |
| 2008/0214786 | A1 | 9/2008 | Oyama | |
| 2010/0062935 | A1 | 3/2010 | Takagi et al. | |
| 2010/0099557 | A1 | 4/2010 | Makihara et al. | |
| 2010/0248959 | A1 | 9/2010 | Kato et al. | |
| 2011/0105319 | A1 | 5/2011 | Hirai et al. | |
| 2011/0130281 | A1 | 6/2011 | Kurihara et al. | |
| 2011/0269622 | A1 | 11/2011 | Ohse et al. | |
| 2012/0038737 | A1 | 2/2012 | Hirai et al. | |

FOREIGN PATENT DOCUMENTS

| | | |
|---|---|---|
| EP | 0 764 635 | 3/1997 |
| EP | 1 116 713 | 7/2001 |
| EP | 1 199 185 | 4/2002 |
| EP | 1 437 231 | 7/2004 |
| EP | 2 072 274 | 6/2009 |
| EP | 2 145 771 | 1/2010 |
| GB | 2 187 297 | 9/1987 |
| JP | 53-091995 | 8/1978 |
| JP | 54-128349 | 10/1979 |
| JP | 57-165290 | 10/1982 |
| JP | 60-179190 | 9/1985 |
| JP | 60-179290 | 9/1985 |
| JP | 61 181680 | 8/1986 |
| JP | 61 291179 | 12/1986 |
| JP | 62-270383 | 11/1987 |
| JP | 1-196389 | 8/1989 |
| JP | 2-55188 | 2/1990 |
| JP | 03 047790 | 2/1991 |
| JP | 3-190786 | 8/1991 |
| JP | 3-205181 | 9/1991 |
| JP | 3-219993 | 9/1991 |
| JP | H04-164687 | 6/1992 |
| JP | 05-139033 | 6/1993 |
| JP | 5-162443 | 6/1993 |
| JP | 5-221115 | 8/1993 |
| JP | H06-155916 | 6/1994 |
| JP | 6-234275 | 8/1994 |
| JP | 6-262853 | 9/1994 |
| JP | H06-270547 | 9/1994 |
| JP | 6-340171 | 12/1994 |

(Continued)

OTHER PUBLICATIONS

Notification of Transmittal of Translation of International Preliminary Report on Patentability corresponding to International Application No. PCT/JP2008/054719 dated Oct. 29, 2009.
International Search Report corresponding to International Patent Application No. PCT/JP2007/074385 dated Feb. 14, 2008.
International Search Report corresponding to International Patent Application No. PCT/JP2008/054719 dated Sep. 22, 2008.
International Search Report corresponding to International Patent Application No. PCT/JP2008/058329 dated Jun. 9, 2008.
International Search Report corresponding to International Pantent Application No. PCT/JP2008/064904 dated Oct. 7, 2008.
Notification of Transmittal of Translation of the International Preliminary Report on Patentability (Chapter I or Chapter II of the Patent Cooperation Treaty) corresponding to International Patent Application No. PCT/JP2007/074385 dated Mar. 18, 2010.
Notification of Transmittal of Translation of the International Preliminary Report on Patentability (Chapter I or Chapter II of the Patent Cooperation Treaty) corresponding to International Patent Application No. PCT/JP2008/058329 dated Jan. 21, 2010.

(Continued)

*Primary Examiner* — Bruce H Hess
(74) *Attorney, Agent, or Firm* — Jenkins, Wilson, Taylor & Hunt, P.A.

(57) ABSTRACT

The present invention presents a thermosensitive recording medium having excellent color development, image quality and preservation properties as well as excellent stamp receptivity, anti-scratching ability, printability and water blocking resistance.
The present invention is a thermosensitive recording medium having a thermosensitive recording layer comprising at least a colorless or pale colored basic leuco dye and an electron accepting developing agent as a coating layer on a substrate, wherein at least an outermost layer among the thermosensitive recording layer and other optionally prepared coated layers contains rice starch particles.

5 Claims, 2 Drawing Sheets

FOREIGN PATENT DOCUMENTS

| | | |
|---|---|---|
| JP | 7149713 | 6/1995 |
| JP | 07-179041 | 7/1995 |
| JP | H07-266711 | 10/1995 |
| JP | 07-314896 | 12/1995 |
| JP | H08-059603 | 3/1996 |
| JP | 08-207443 | 8/1996 |
| JP | 08-324123 | 12/1996 |
| JP | H08-333329 | 12/1996 |
| JP | H09-142018 | 6/1997 |
| JP | H09-207435 | 8/1997 |
| JP | H09-263047 | 10/1997 |
| JP | H10-250232 | 9/1998 |
| JP | H10-258577 | 9/1998 |
| JP | 10-272839 | 10/1998 |
| JP | H10-297089 | 11/1998 |
| JP | H10-297090 | 11/1998 |
| JP | 10-324062 | 12/1998 |
| JP | 10-324064 | 12/1998 |
| JP | 11-314454 | 11/1999 |
| JP | 2000-143611 | 5/2000 |
| JP | 2000-177243 | 6/2000 |
| JP | 2000-289333 | 10/2000 |
| JP | 2001-323095 | 11/2001 |
| JP | 2002-011954 | 1/2002 |
| JP | 2002-019300 | 1/2002 |
| JP | 2002-264538 | 9/2002 |
| JP | 2002-293023 | 10/2002 |
| JP | 2002-301873 | 10/2002 |
| JP | 2003-019861 | 1/2003 |
| JP | 2003-154760 | 5/2003 |
| JP | 2003-212841 | 7/2003 |
| JP | 3439560 | 8/2003 |
| JP | 2003-313795 | 11/2003 |
| JP | 2004-202913 | 7/2004 |
| JP | 2005-041013 | 2/2005 |
| JP | 2005-199554 | 7/2005 |
| JP | 2005-262549 | 9/2005 |
| JP | 2006-069032 | 3/2006 |
| JP | 2006-095852 | 4/2006 |
| JP | 3790648 | 6/2006 |
| JP | 2006-175835 | 7/2006 |
| JP | 2006-264255 | 10/2006 |
| JP | 2006-281472 | 10/2006 |
| JP | 2007-196616 | 8/2007 |
| JP | 2008-012879 | 1/2008 |
| JP | 2008-018619 | 1/2008 |
| JP | 2008-044226 | 2/2008 |
| JP | 2008-044227 | 2/2008 |
| JP | 2008-105222 | 8/2008 |
| JP | 2008-194918 | 8/2008 |
| WO | WO93/06074 | 4/1993 |
| WO | WO95/33714 | 12/1995 |
| WO | WO97/16420 | 5/1997 |
| WO | WO00/14058 | 3/2000 |
| WO | WO01/25193 | 4/2001 |
| WO | WO02/081229 | 10/2002 |
| WO | WO02/098674 | 12/2002 |
| WO | WO03/029017 | 4/2003 |
| WO | WO2004/002748 | 1/2004 |
| WO | WO2005/087503 | 9/2005 |
| WO | WO2005/087504 | 9/2005 |
| WO | WO2005/102725 | 11/2005 |
| WO | WO2006/075467 | 7/2006 |
| WO | WO2007/049621 | 5/2007 |
| WO | WO2008/099658 | 8/2008 |
| WO | WO2008/126635 | 10/2008 |
| WO | WO2008/139948 | 11/2008 |
| WO | WO2009/025316 | 2/2009 |
| WO | WO2009/028118 | 3/2009 |
| WO | WO2009/119813 | 10/2009 |
| WO | WO2010/110209 | 9/2010 |
| WO | WO2010/140662 | 12/2010 |

OTHER PUBLICATIONS

Notification of Transmittal of Translation of the International Preliminary Report on Patentability (Chapter I or Chapter II of the Patent Cooperation Treaty) corresponding to International Patent Application No. PCT/JP2008/064904 dated Mar. 18, 2010.

Supplementary European Search Report corresponding to European Patent Application No. 08722115.6-1251/2130681 dated Mar. 5, 2010.

European Search Report corresponding to European Patent Application No. 09 725 687.9-2304 dated Feb. 24, 2012.

Extended European Search Report corresponding to European Patent Application No. 08 827 733.0-2304 dated Jan. 27, 2012.

International Search Report corresponding to International Patent Application No. PCT/JP2008/051100 dated Apr. 15, 2008.

International Search Report corresponding to International Patent Application No. PCT/JP2009/056306 dated May 19, 2009.

International Search Report corresponding to International Patent Application No. PCT/JP2010/054818 dated Apr. 13, 2010.

International Search Report corresponding to International Patent Application No. PCT/JP2010/059462 dated Aug. 17, 2010.

Isogai et al., "Effects of Carboxyl Groups in Pulp on Retention of Alkylketene Dimer," Journal of Pulp and Paper Science. vol. 23, No. 5 pp. J215-J219 (1997).

Japanese Industrial Standard (JIS) P-8148. Paper, board and pulps—Measurement of diffuse blue reflectance factor (ISO brightness). Japanese Standards Association (2001).

Notice of Allowance corresponding to U.S. Appl. No. 12/520,514 dated Oct. 26, 2011.

Notice of Allowance corresponding to U.S. Appl. No. 12/599,617 dated Apr. 16, 2012.

Notification Concerning Transmittal of International Preliminary Report on Patentability (Chapter I of the Patent Cooperation Treaty) corresponding to International Patent Application No. PCT/JP2009/056306 dated Oct. 7, 2010.

Notification Concerning Transmittal of International Preliminary Report on Patentability (Chapter I of the Patent Cooperation Treaty) corresponding to International Application No. PCT/JP2010/054818 dated Sep. 24, 2011.

Notification of Transmittal of Translation of the International Preliminary Report on Patentability (Chapter I or Chapter II of the Patent Cooperation Treaty) corresponding to Interbational Application No. PCT/JP2008/051100 dated Aug. 27, 2009.

Notification of Transmittal of Translation of the International Preliminary Report on Patentability (Chapter I or Chapter II of the Patent Cooperation Treaty) corresponding to International Patent Application No. PCT/JP2009/056306 dated Nov. 18, 2010.

Notification of Transmittal of Translation of the International Preliminary Report on Patentability (Chapter I or Chapter II of the Patent Cooperation Treaty) corresponding to International Patent Application No. PCT/JP2010/054818 dated Jan. 12, 2012.

Notification of Transmittal of Translation of the International Preliminary Report on Patentability (Chapter I or Chapter II of the Patent Cooperation Treaty) corresponding to International Patent Application No. PCT/JP2010/059462 dated Dec. 15, 2011.

Official Action corresponding to U.S. Appl. No. 12/520,514 dated Mar. 10, 2010.

Official Action corresponding to U.S. Appl. No. 12/520,514 dated Oct. 27, 2010.

Supplementary European Search Report corresponding to European Patent Application No. 08703912.9-1251/2112001 dated Jan. 22, 2010.

* cited by examiner

THERMOSENSITIVE RECORDING MEDIUM

FIELD OF THE INVENTION

The present invention relates to a thermosensitive recording medium for recording image by utilizing a color formation reaction between a basic leuco dye and an electron accepting color developing agent.

BACKGROUND OF THE INVENTION

A thermosensitive recording medium is obtained by grinding a colorless or pale colored basic leuco dye (henceforth referred to as "dye") and an electron accepting color developing agent (henceforth referred to as "color developing agent") each into fine particles, preparing dispersions, blending the dispersions, preparing a coating solution by adding a binder, a filler, a sensitivity improving agent, a lubricant and other aids and applying the coating solution on a support material such as paper, synthetic paper, film, plastic and the like. The color is developed instantaneously through a chemical reaction when heated using a thermal head, hot stamp, thermal pen, laser beam and the like to yield a recorded image. The thermosensitive recording medium is used extensively in facsimiles, terminal printers of computers, automatic ticket vending machines, measurement recorders and the like. Furthermore, the thermosensitive recording medium is also used to prepare documents such as various tickets, receipts, labels, bank ATM receipts, gas and electric meter print outs, transportation tickets and the like.

However, the dye and color developing agent present in a thermosensitive recording layer readily dissolve in various solvents, and preservation problems such as color development in blank paper, a decline in developed color intensity and the like are encountered when a plasticizer such as those present in inks (water and oil based inks), adhesives and the like comes in contact with a thermosensitive recording medium. In addition, papers for shipping slips, bills, receipts and the like need to be stamped, and stamp reception becomes a required quality as well as preservation.

For these reasons, thermosensitive recording media (References 1 and 2) wherein a protective layer containing inorganic pigments and porous starch particles has been installed on the thermosensitive recording layer have been used.

In addition, some thermosensitive recording media with protective layers containing aqueous starch solutions that had been gelatinized by heating and those with easily soluble modified starches have been proposed (References 3 and 4).

Reference 1: Japanese Patent Application Public Disclosure No. 2000-289333

Reference 2: Japanese Patent Application Public Disclosure No. 2000-177243

Reference 3: Japanese Patent No. 3324872

Reference 4: Japanese Patent Application Public Disclosure No. H09-263047

Problems to be Solved by the Invention

Thermosensitive recording media containing silica that absorbs oil well (Reference 1 etc.) or thermosensitive recording media containing porous starch particles (Reference 2 etc.) could have good stamping properties since they can absorb and fix ink. However, surface strength and coating layer strength are difficult with these technologies to achieve since silica and porous particles absorb the binder. In addition, blanket fouling is encountered in general printability (henceforth referred to "printability").

In addition, when starch particles are used in a gelatinized state not in a particulate shape (References 3, 4 etc.), good stamping properties, ink receptivity in printability and adequate color development sensitivity cannot be achieved, since a starch film is formed on the surface.

Therefore, the objective of the present invention is to present a thermosensitive recording medium having excellent color development, image quality and preservation properties as well as excellent stamp receptivity, anti-scratching ability, printability (blanket fouling and ink fixability) and water blocking resistance.

Means to Solve the Problems

The inventors investigated the performance of thermosensitive recording media containing various non-gelatinized plant derived starches in the thermosensitive recording layer, protective layer and the like of the thermosensitive recording media. Then the inventors discovered that the objective described above could be accomplished by having rice starch particles present in the outermost layer constituting the thermosensitive recording medium, and the present invention was completed based on the discovery.

That is, the present invention is a thermosensitive recording medium having at least a thermosensitive recording layer comprising a colorless or pale colored basic leuco dye and an electron accepting developing agent as a coating layer on a substrate, wherein at least an outermost layer among the thermosensitive recording layer and other optionally applied coating layers contains rice starch particles.

Advantages of the Invention

According to the present invention, a thermosensitive recording medium can be obtained with adequate color development sensitivity and good stamp receptivity, anti-scratching properties, printability (blanket fouling and ink fixability) and water blocking resistance.

DETAILED DESCRIPTION OF THE INVENTION

Figure 1:
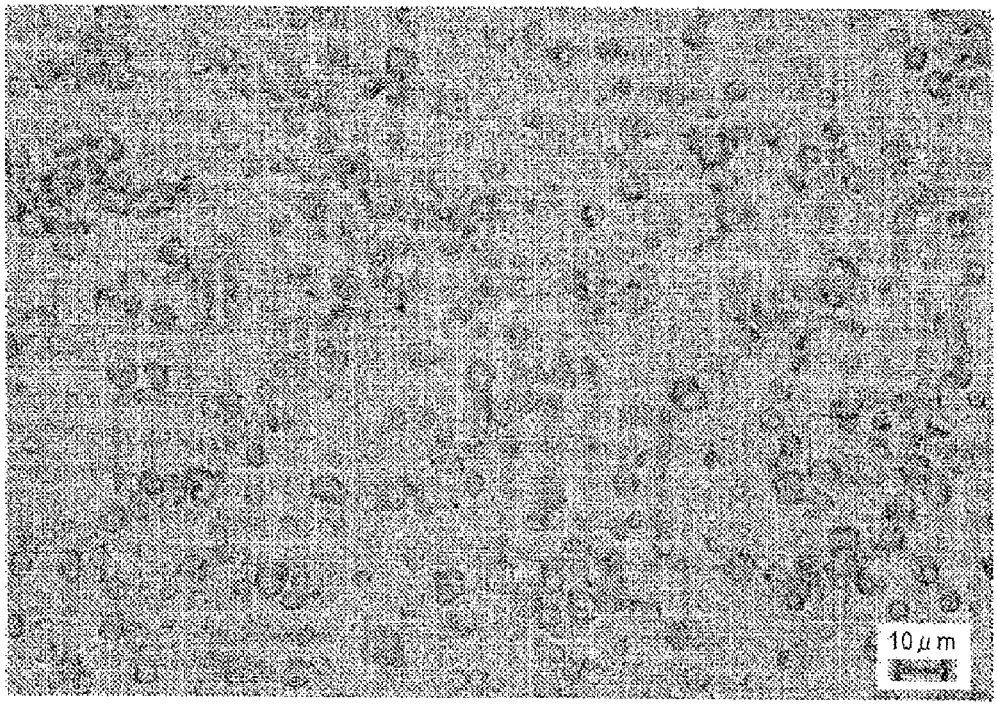
FIG. 1 shows a transmission electron microscope photograph of rice starch particles.

The embodiment of the present invention is explained below.

The thermosensitive recording medium of the present invention contains rice starch particles on the outermost layer of the coating layers installed on a support material.

Starch is in the form of particles when removed from plants, and the particle size and shape are different depending on the plants from which the starch is derived (See FIGS. 1-4.).

The rice starch particles used in the present invention have an average particle size of from 2 μm to 7 μm and are polygonal in shape. Rice starch particles have a smaller average particle size than the average particle sizes of starch derived from corn (corn starch), starch derived from wheat (wheat starch, concave lens shaped), starch derived from potatoes (potato starch), starch derived from yams (yam starch, bell shapes) and starch derived from tapioca (tapioca starch, semi-spherical shapes), and the shape is unique (See FIGS. 1-4.).

The inventors studied the difference in the performance of thermosensitive recording media when starch particles derived from various plants were present in the outermost layer of the thermosensitive recording media. As a result, the inventors observed excellent performance when rice starch with the smallest particle size was used (See Examples presented later.).

Starch generally forms a paste when heated with water. When starch is suspended in water and heated, starch particles absorb water and gradually swell. The starch particles eventually collapse when the heating is continued and form a gel. This phenomenon is referred to as "gelatinization". The gelatinization of starch is caused by loosening of the starch structure through insertion of water molecules in the gaps between starch molecules and a spreading of individual starch branches in water. During the gelatinization process, the starch particle suspension gradually changes from turbid to clear and suddenly becomes viscous. The viscosity reaches a maximum level when the particles absorb the maximum amount of water, and the viscosity declines as particles collapse.

The gelatinization temperature of rice starch particles is from 63° C. to 65° C. Rice starch particles maintain their particulate shapes at temperatures below that level since rice starch particles coexist with water. However, the particulate shape disappears, and the starch dissolves in water to form a gel when heated to above the temperature.

Starch in some cases is used as a binder in thermosensitive recording media to increase the coating layer strength (For example, References 3 and 4.). In these cases, gelatinized starch is used. When the gelatinized starch is used, the color development and stamping properties of the coating layers targeted by 10 the present invention cannot be achieved (See Comparative Example 7 described later.).

Therefore, the temperature needs to be maintained below the gelatinization temperature of rice starch particles, preferably below 60° C., more preferably below 50° C. and further preferably below 40° C. when preparing a coating solution containing rice starch particles.

In addition, starch may be used in the form of particles as it is removed from the plants (rice) or may be used after a treatment such as oxidation, etherification, esterification and the like. In addition, the rice starch used in the present invention has a different shape and different properties than porous starch particles (Reference 2 etc.) made porous using an enzymatic treatment.

The properties of the rice starch particles used in the present invention are shown below.

Average particle size: 2-7 μm (measured using a laser diffraction method)

Bulk density: 0.3-0.7 g/cm$^3$ (measured according to JIS Z8901)

Water absorption: 50-100% by weight (measured according to JIS K7209)

Refractive index: 1.62-1.65 (measured using Abbe refractometer after dissolving the particles in hot water to form a film and after drying the film)

Amylopectin content after drying: At least 80% (measured using a warm water extraction method)

The reason why excellent stamping and anti-scratching properties are realized by the presence of rice starch particles with an average particle size of from 2 μm to 7 μm in the outermost layer is not clearly understood. However, the realization is considered to be attributed to the shape (that is, particle size), but other properties may be involved.

The coating layer containing rice starch particles in the present invention absorbs and fixes the ink from a vermillion ink pad, printing ink and the like using voids formed by the rice starch particles, and the ink is also absorbed and fixed into the voids contained in the rice starch particles themselves to yield good stamping properties and printability (ink fixability). The size of the voids created by rice starch particles with an average particle size of from 2 μm to 7 μm is thought to be suitable for absorbing and fixing vermillion seal ink and printing ink.

In addition, the surfaces of rice starch particles in a water based paint swell with water and the particles function as a binder. Therefore, the rice starch particles adhere to each other when a coating layer containing rice starch particles is formed through application and drying. Thus excellent surface strength or coating layer strength is achieved, and good printability (blanket fouling) is realized. In addition, the starch particles used in the present invention contain fewer voids than porous starch and inorganic pigments such as silica and calcium carbonate that are conventionally used to improve stamping properties. As a result, binder penetration into starch particles is difficult, and the good surface strength or coating layer strength obtained is one of the reasons for achieving excellent printability (blanket fouling).

Furthermore, the layer containing rice starch particles is softer than one containing inorganic pigments such as silica and calcium carbonate and the like and is thought to contribute toward good anti-scratching properties. The fact that the shape of the rice starch particles is polygonal is particularly important in reducing the contact area and is thought to contribute to good anti-scratching properties. In addition, the refractive index of starch particles is less different from those of a binder such as starch, polyvinyl alcohol and the like added to the same layer than those of inorganic pigments such as silica and calcium carbonate and the like, and starch particles are less likely to cause internal scattering (internal haze). Therefore, good color development sensitivity and image quality can be achieved when rice starch particles are contained in a thermosensitive recording layer or in a coating layer formed on a thermosensitive recording layer.

A thermosensitive recording medium is ordinarily constructed by laminating an undercoating layer, a thermosensitive recording layer and a protective layer in that order as coating layers on a support material. Of these, the coating layers other than the thermosensitive recording layer are sometimes eliminated, and an intermediate layer is sometimes installed between a thermosensitive recording layer and a protective layer. It is desirable to have a protective layer for the thermosensitive recording medium of the present invention from the standpoint of preserving images and the blank section.

A thermosensitive recording medium of the present invention contains rice starch particles with an average particle size of from 2 μm to 7 μm in the outermost layer. The examples of such a thermosensitive recording medium include, (1) a thermosensitive recording medium having a thermosensitive recording layer containing rice starch particles (with no protective layer) on a support material, (2) a thermosensitive recording medium having a thermosensitive recording layer/a protective layer containing rice starch particles in this order on a support material and (3) a thermosensitive recording medium having an undercoating layer/a thermosensitive recording layer/a protective layer containing rice starch particles in this order on a support material. However, the thermosensitive recording medium of the present invention is not limited to these examples. Now rice starch particles may be present in a layer other than the outermost layer.

Next, examples of various materials used in the present invention are shown. The thermosensitive recording layer of the present invention contains essentially a dye and a color developing agent and may also optionally contain sensitizers, binders, crosslinking agents, stabilizers, pigments, lubricants and the like as needed in addition to the rice starch particles described above. The binders, crosslinking agents, pigments and the like may be used not only in the coating layer containing rice starch particles but also in individual coating layers installed as needed, such as protective layers, undercoating layers and the like, in a range that does not interfere with the desired effects to achieve the objective described above.

All of the dyes well known in the conventional field of pressure sensitive and thermosensitive recording media may be used as the dye in a thermosensitive recording medium of the present invention. Although the dye is not particularly restricted, triphenylmethane type compounds, fluorane type compounds, fluorene type compounds, divinyl type compounds and the like are preferred. Specific examples of the typical colorless to pale colored basic colorless dye are shown below. In addition, these basic colorless dyes may be used individually or also in mixtures of at least two of them.

<Triphenylmethane Type Leuco Dyes>

3,3-bis(p-Dimethyl aminophenyl)-6-dimethylaminophthalide [alternate name: crystal violet lactone] and 3,3-bis(p-Dimethyl aminophenyl) phthalide [alternate name: malachite green lactone]

<Fluorane Type Leuco Dyes>

3-Diethylamino-6-methylfluorane, 3-diethylamino-6-methyl-7-aniline fluorane, 3-diethylamino-6-methyl-7-(o,p-dimethylanilino) fluorane, 3-dibutylamino-6-methyl-fluorane, 3-dibutylamino-6-methyl-7-anilinofluorane, 3-dibutylamino-6-methyl-7-(o,p-dimethylanilino) fluorane, 3-dibutylamino-7-(o-chloroanilino) fluorane, 3-dibutylamino-7-(o-fluoroanilino) fluorane, 3-n-dipentylamino-6-methyl-7-anilino fluorane, 3-(N-ethyl-N-isoamylamino)-6-methyl-7-anilino fluorane, 3-(N-ethyl-N-isoamylamino)-6-chloro-7-anilino fluorane and 3-cyclohexylamino-6-chlorofluoroane.

<Divinyl Type Leuco Dyes>

3,3-bis-[2-(p-Dimethyl aminophenyl)-2-(p-methoxyphenyl) ethenyl]-4,5,6,7-tetrabromophthalide, 3,3-bis-[2-(p-dimethylaminophenyl)-2-(p-methoxy phenyl) ethenyl]-4,5,6,7-tetrachlorophthalide, 3,3-bis-[1,1-bis(4-pyrolidino phenyl) ethylene-2-yl]-4,5,6,7-tetrabromophthalide and 3,3-bis-[1-(4-methoxy phenyl)-1-(4-pyrolydinophenyl) ethylene-2-yl]-4,5,6,7-tetrchlorophthalide.

<Others>

3-(4-Diethylamino-2-ethoxyphenyl)-3-(1-ethyl-2-methylindol-3-yl)-4-azap hthalide, 3-(4-diethylamino-2-ethoxyphenyl)-3-(1-octyl-2-methylindol-3-yl)-4-azaphthalide, 3-(4-cyclohexyl ethylamino-2-methoxyphenyl)-3-(1-ethyl-2-methylindol-3-yl)-4-azaphthalide, 3,3-bis(1-ethyl-2-methylindol-3-yl)phthalide, 3,6-bis(diethylamino)fluorane-γ-(3'-nitroanilinolactam, 3,6-bis(diethylamino) fluorane-γ-(4'-nitro) anilinolactam, 1,1-bis-[2',2',2",2"-tetrakis-(p-dimethylamino phenyl)-ethenyl]-2,2-dinitrilethane, 1,1-bis-[2',2',2",2"-tetrakis-(p-dimethylaminophenyl)-ethenyl]-2-β-naphthoylethane, 1,1-bis-[2',2',2",2"-tetrakis-(p-dimethylaminophenyl)-ethenyl]-2,2-diacetylethane and bis-[2,2,2',2'-tetrakis-(p-dimethylaminophenyl)-ethenyl]-methylmalonic acid dimethyl ester.

All of the color developing agents well known in the conventional field of pressure sensitive and thermosensitive recording media may be used as the color developing agent in a thermosensitive recording medium of the present invention. Although the dye is not particularly restricted, activated clay, attapulgite, colloidal silica, inorganic acidic substances such as aluminum silicate and the like, 4,4'-isopropylidene diphenol, 1,1-bis(4-hydroxyphenyl) cyclohexane, 2,2-bis(4-hydroxyphenyl)-4-methylpentane, 4,4'-dihydroxydiphenyl sulfide, hydroquinone monobenzyl ether, benzyl 4-hydroxybenzoate, 4,4'-dihydroxy diphenyl sulfone, 2,4'-dihydroxy diphenyl sulfone, 4-hydroxy-4'-isopropxy diphenyl sulfone, 4-hydroxy-4'-n-propoxy diphenyl sulfone, bis(3-allyl-4-hydroxyphenyl) sulfone, 4-hydroxy-4'-methyl diphenyl sulfone, 4-hydroxyphenyl-4'-benzyloxyphenyl sulfone, 3,4-dihydroxyphenyl-4'-methyl phenyl sulfone, aminobenzene sulfonamide derivatives described in Japanese Patent Application Public Disclosure No. 1108-59603, bis(4-hydroxyphenyl thioethoxy) methane, 1,5-di(4-hydroxyphenyl thio)-3-oxapentane, butyl bis(p-hydroxyphenyl)acetate, methyl bis(p-hydroxyphenyl)acetate, 1,1-bis(4-hydroxyphenyl)-1-phenyl ethane, 1,4-bis[α-methyl-α-(4'-hydroxyphenyl)ethyl]benzene, 1,3-bis[α-methyl-α-(4'-hydroxyphenyl) ethyl]benzene, di(4-hydroxy-3-methylphenyl) sulfide, 2,2'-thiobis(3-tert-octylphenol), 2,2'-thiobis(4-tert-octylphenol), phenolic compounds such as diphenyl sulfone crosslinked compounds and the like described in International Publication WO97/16420, phenolic compounds described in International Publication WO02/081229 or Japanese Patent Application Public Disclosure No. 2002-301873, phenol novolak type condensation composition described in International Publication WO02/098674 or WO03/029017, urea urethane compounds described in International Publication WO00/14058 or Japanese Patent Application Public Disclosure No. 2000-143611, thiourea compounds such as N,N'-di-m-chlorophenyl thiourea and the like, p-chlorobenzoic acid, stearyl gallate, bis[zinc 4-octyloxy carbonylamino]salicylate dihydrate, 4-[2-(p-methoxyphenoxy) ethyloxy]salicylic acid, 4-[3-(p-trisulfonyl) propyloxy]salicylic acid, aromatic carboxylic acids such as 5-[p-(2-p-methoxyphenoxyethoxy) cumyl]salicylic acid and salts of these aromatic carboxylic acids and polyvalent metals such as zinc, magnesium, aluminum, calcium, titanium, manganese, tin, nickel and the like, and, furthermore, antipirin complexes of zinc thiocyanate and complex zinc salts and the like of terephthal aldehyde acid with other aromatic carboxylic acids, for example, may be cited. These color developing agents may be used individually or in mixtures of at least two. In addition, high molecular weight aliphatic acid metal complex salts described in Japanese Patent Application Public Disclosure No. H10-258577 and metal chelate type color development components such as polyvalent hydroxy aromatic compounds and the like may also be present.

In addition previously well known sensitizers may be used in ranges that do not interfere with the desired effects. As such sensitizers, aliphatic acid amides such as stearic acid amide, pahnitic acid amide and the like, ethylene bis-amide, montan acid wax, polyethylene wax, 1,2-di-(3-methylphenoxy) ethane, p-benzyl biphenyl, β-benzyloxy naphthalene, 4-biphenyl-p-tolyl ether, m-terphenyl, 1,2-diphenoxyethane, dibenzyl oxalate, di(p-chlorobenzyl) oxalate, di(p-methylbenzyll oxalate, dibenzyl terephthalate, benzyl p-benzyloxy benzoate, di-p-tolyl carbonate, phenyl-α-naphthyl carbonate, 1,4-diethoxynaphthalene, 1-hydroxy-2-naphthoic acid phenyl ester, o-xylene-bis-(phenyl ether), 4-(m-methyl phenoxymethyl) biphenyl, 4,4'-ethylene dioxy-bis-benzoic acid dibenzyl ester, dibenzoyloxy methane, 1,2-di(3-methylphenoxy) ethylene, bis[2-(4-methoxy-phenoxy)ethyl]ether, methyl p-nitrobenzoate and phenyl p-toluene sulfonate may be listed as examples, but the sensitizer is not particularly limited to these examples. These sensitizers may be used individually or as mixtures of at least two of them.

As the binder used in the present invention, completely saponified polyvinyl alcohol, partially saponified polyvinyl alcohol, acetoacetylated polyvinyl alcohol, carboxyl modified polyvinyl alcohol, amide modified polyvinyl alcohol, sulfonic acid modified polyvinyl alcohol, butyral modified polyvinyl alcohol, olefin modified polyvinyl alcohol, nitrile modified polyvinyl alcohol, pyrolidone modified polyvinyl alcohol, silicone modified polyvinyl alcohol, other modified poly(vinyl alcohols), hydroxyethyl cellulose, methyl cellulose, ethyl cellulose, carboxymethyl cellulose, styrene-maleic anhydride copolymers, styrene-butadiene copolymers, cellulose derivatives such as ethyl cellulose and acetyl cellulose, casein, Arabia rubber, oxidized starch, etherified starch, dialdehyde starch, esterified starch, poly(vinyl chloride), poly(vinyl acetate), polyacrylamide, polyacrylate esters, poly (vinyl butyral), polystyrols and their copolymers, polyamide resins, silicone resins, petroleum resins, terpene resins, ketone resins, cumaron resins and the like may be listed as examples. These polymeric substances may be used upon dissolving them in water, an alcohol, ketones, esters, a hydrocarbon and the like or in the form of emulsions or pastes upon dispersion in water or other media. They may be combined depending on the quality needed.

The installation of a protective layer containing as the binder carboxyl modified polyvinyl alcohol, epichlorohydrin type resin and polyamine/amide type resin is particularly desirable in a thermosensitive recording medium of the present invention from the standpoint of water resistance and print moving properties.

The carboxyl modified polyvinyl alcohol is produced as a reaction product between polyvinyl alcohol and multi-valent carboxylic acid such as fumaric acid, phthalic anhydride, mellitic anhydride, and itaconic anhydride; or an esterified products of these reactants; or a saponified product of a copolymer between vinyl acetate and ethylated unsaturated dicarboxylic acid such as maleic acid, fumaric acid, itaconic acid, crotonic acid, acrylic acid, and metacrylic acid. Specifically, the production process includes, for example, the production process exemplified in Example 1 or 4 of Japanese Patent Application Public Disclosure No. 53-91995, publication. Moreover, the saponification value of the carboxyl modified polyvinyl alcohol is preferably ranging from 72 to 100 mol %, and the degree of polymerization is ranging from 500 to 2400, preferably from 1000 to 2000.

Specific examples of the epichlorohydrin resin include a polyamide epichlorohydrin resin, a polyamine epichlorohydrin resin and the like, and these compounds can be used solely or in combination. As the amines in backbone chain of the epichlorohydrin resin, any amine from primary amines to quaternary amines can be used without restrictions. Furthermore, the cationization level of the epichlorohydrin resin is preferably less than 5 meq/g·solid (measured at pH 7) and the molecular weight is preferably more than 500,000, since the epichlorohydrin resin has a good water resistance. Specific examples of the epichlorohydrin resin include Sumirez resin 650(30), Sumirez resin 675A, Sumirez resin 6615 (Sumitomo Chemicals), WS4002, WS4020, WS4024, WS4046, WS4010, and CP8970 (SeikoPMC).

The polyamine/amide resin includes polyamide urea resin, polyalkylene polyamine resin, polyalkylene polyamide resin, polyamine polyurea resin, modified polyamine resin, modified polyamide resin, polyalkylene polyamine urea formalin resin, and polyalkylene polyamine polyamide polyurea resin. Specific examples include Sumirez resin 302 (Sumitomo Chemicals: polyamine polyurea resin), Sumirez resin 712 (Sumitomo Chemicals: polyamine polyurea resin), Sumirez resin 703 (Sumitomo Chemicals: polyamine polyurea resin), Sumirez resin 636 (Sumitomo Chemicals: polyamine polyurea resin), Sumirhez resin SPI-100 (Sumitomo Chemicals: modified polyamine resin), Sumirez resin SPI-102A (Sumitomo Chemicals: modified polyamine resin), Sumirez resin SPI-106N (Sumitomo Chemicals: modified polyamide resin), Sumirez resin SPI-203(50)(Sumitomo Chemicals), Sumirez resin SPI-198 (Sumitomo Chemicals), PrintiveA-700 (Asahi Kasei Corporation), PrintiveA-600 (Asahi Kasei Corporation), PA6500, PA6504, PA6634, PA6638, PA6640, PA6644, PS6646<PA6654, PA6702, PA 6704 (the above, SeikoPMC: polyalkylene polyamine polyamide polyurea resin), and CP8994 (SeikoPMC: polyethylene imine resin) without any restriction, they can be used solely or in combination of two kinds or more. From the viewpoint of recording sensitivity, polyamine resin (polyalkylene polyamine resin, polyamine polyurea resin, modified polyamine resin, polyalkylene polyamine urea formalin resin, polyalkylene polyamine polyamide polyurea resin) are preferable.

The content of the epichlorohydrin resin and the modified polyamine/amide resin are preferably ranging from 1 to 100 weight parts, more preferably from 5 to 50 weight parts, respectively, based on 100 weight parts of the carboxyl modified polyvinyl alcohol. When these contents are less, the cross-linking reaction becomes incomplete and the water resistance becomes worse. On the other hand, when these contents are more, the problem associated with an increased viscosity and a gelling of coating liquid will happen, and the operating performance becomes worse.

When the protecting layer containing the carboxyl modified polyvinyl alcohol, the epichlorohydrin resin and the polyamine/amide resin, the thermosensitive recording layer contacting the protecting layer preferably contains the epichlorohydrin resin and/or the carboxyl modified polyvinyl alcohol. Subjecting the thermosensitive recording layer to contain the component contained in the protecting layer makes better adhesion between the thermosensitive recording layer and the protecting layer and increases water resistance for dipping. The thermosensitive recording layer preferably contains 0.2 to 5.0 weight portions (dry weight) of the epichlorohydrin resin. The more is the content of epichlorohydrin resin, the less is the stability of coating.

Kaolin, calcined kaolin, calcium carbonate, aluminum oxide, titanium oxide, magnesium carbonate, aluminum silicate, magnesium silicate, calcium silicate, aluminum hydroxide, silica and the like may be listed as examples of the pigment used in the present invention. However, the pigment is not limited to these examples.

Glyoxal, methylol melamine, melamine formaldehyde resins, melamine urea resins, polyamine epichlorohydrin resins, polyamide epichlorohydrin resins, potassium persulfate, ammonium persulfate, sodium persulfate, ferric chloride, magnesium chloride, boron sand, boric acid, alum, ammonium chloride and the like may be listed as examples of the crosslinking agent used in the present invention.

Fatty acid metal salts such as zinc stearate, calcium stearate and the like, wax, silicone resins and the like may be cited as the lubricant used in the present invention.

4,4'-Butylidene(6-t-butyl-3-methylphenol), (2,2'-di-t-butyl-5,5'-dimethyl-4,4'-sulfonyl diphenol, 1,1,3-tris(2-methyl-4-hydroxy-5-cyclohexylphenyl) butane, 1,1,3-tris(2-methyl-4-hydroxy-5-t-butylphenyl) butane, 4-benzyloxy-4'-(2,3-epoxy-2-methylpropoxy)diphenyl sulfone and the like may be added as image stabilizing agents in ranges that do not interfere with the desired effects for the objectives of the present invention in order to yield oil resistance in recorded images.

In addition, UV absorber such as benzophenone and triazole, dispersing agents, antifoam agents, antioxidants, fluorescent dyes and the like can be used.

The type and amount of the dye, color developing agent and other various ingredients used in a thermosensitive recording layer in the present invention are determined according to the performance and recording capability required and are not particularly restricted. Ordinarily, however, the use of from 0.5 to 10 parts of a color developing agent and from about 0.5 to 10 parts of a pigment (including rice starch particles) are used per part of a basic colorless dye. The use of from about 5% to 25% of a binder in the thermosensitive recording layer solid content is appropriate.

In the present invention, the presence of at least 20 parts by weight of rice starch particles in terms of solid content per 100 parts by weight of the solid content in the layer containing the rice starch particles is preferred, and the presence of from 30 to 80 parts by weight is more preferred.

In addition, the presence of the binder mentioned above in a layer containing rice starch particles is preferred in order to impart water resistance.

When rice starch particles are present in a protective layer, the presence of from 50% to 80% by weight of the rice starch particles based on the total solids fraction is preferred. The binder is present in from about 20% to 100% by weight based on the rice starch particles.

When rice starch particles are present in a thermosensitive recording layer constituting the outermost layer, the concentration of the rice starch particles is from about 1% to 20% by weight based on the total solids fraction in the thermosensitive recording layer and the binder is present in from about 30% to 300% by weight in terms of the solids fraction based on the rice starch particles.

When rice starch particles are present in a thermosensitive recording layer that is not the outermost layer or an undercoating layer, the rice starch particle concentration based on the total solids fraction is ordinarily from about 10% to 95% by weight.

A target thermosensitive recording medium can be obtained by applying a coating solution comprising a composition described above on an optional support material such as paper, recycled paper, synthetic paper, film, plastic film, plastic foam film, non-woven cloth and the like. In addition, a composite sheet combining these support materials may also be used as the support material.

The dye, color developing agent and materials added when needed are finely ground into particles, several microns or smaller in size, using a grinder or a suitable emulsification device such as ball mills, attriters, sand grinders and the like, and a coating solution is prepared by adding a binder and various additive materials depending on the objective. Water, alcohol and the like may be used as the solvent in the coating solution, and its solids fraction is from about 20% to 40%. In addition, the means by which the coating solution is applied is not particularly restricted, and a commonly used technology may be used. For example, off-machine and on-machine devices equipped with various coaters such as air knife coaters, rod blade coaters, bent blade coaters, bevel blade coaters, roller coaters, curtain coaters and the like may be appropriately selected. The coating amount for a thermosensitive recording layer is not particularly limited and is ordinarily in the range of from 2 g/m$^2$ to 12 g/m$^2$ in terms of dry weight. In addition, the coating amount for the protective layer installed on a thermosensitive recording layer is not particularly restricted and is ordinarily in the range of from 1 g/m$^2$ to 5 g/m$^2$.

An undercoating layer comprising a filler and a binder may be further installed between a support material and a thermosensitive recording layer of a thermosensitive recording medium of the present invention for the purpose of enhancing the color development sensitivity. In addition, a back coating layer may be installed on the opposing surface to the thermosensitive recording layer in a support material to correct the curl. Furthermore, various technologies known in the thermosensitive recording medium field, for example, a flattening treatment such as super calendaring and the like conducted after applying individual coating layers using various technologies known in the thermosensitive recording medium field may be used as needed.

The following Examples illustrate the present invention, but it is not intended to restrict the scope of the present invention.

EXAMPLES

The thermosensitive recording medium of the present invention is illustrated below by using examples. "Part" and "%" refer to "weight part" and "weight %", respectively. Average particle size is measured by laser diffraction scattering method (Malvern Co., Using Mastersizer 8).

The compositions of the following formulation were stirred and dispersed to prepare various solution, dispersion liquid or coating liquid.

| [Undercoating layer coating solution] | |
|---|---|
| Calcined kaolin (Engelhard Co., Ansilex, average particle size 3 μm) 30% dispersion | 100 parts |
| Styrene•butadiene copolymer latex (solid content, 48%) | 40 parts |
| 10% Aqueous solution of completely saponified polyvinyl alcohol (PVA117) | 30.0 parts |
| Water | 160 parts |

Color developing agent dispersion liquids (solution A), basic colorless dye dispersion liquids (solution B) and sensitizer dispersion liquids (solution C) with the following formulations were wet ground separately to average particle diameter with 0.5 μm by using a sand grinder.

| Solution A (color developing agent dispersion) | |
|---|---|
| Hydroxy-4'-isopropoxy diphenyl sulfone (Nippon Soda Co., Ltd., D8) | 6.0 parts |
| 10% Aqueous solution of polyvinyl alcohol | 18.8 parts |
| Water | 11.2 parts |

| Solution B (dye dispersion) | |
|---|---|
| 3-Dibutylamino-6-methyl-7-anilinofluorane (Yamada Kagaku Co., ODB-2) | 2.0 parts |
| 10% Aqueous solution of polyvinyl alcohol | 4.6 parts |
| Water | 2.6 parts |

| Solution C (sensitizer dispersion) | |
|---|---|
| Dibenzyl oxalate | 6.0 parts |
| 10% Aqueous solution of polyvinyl alcohol | 18.8 parts |
| Water | 11.2 parts |

Next the dispersions were blended in the proportion below to prepare a coating solution for a thermosensitive recording layer. The liquid temperature of the coating solution during the blending operation was no higher than 30° C.

| [Thermosensitive recording layer coating solution 1] | |
|---|---|
| Solution A (color developing agent dispersion) | 36.0 parts |
| Solution B (dye dispersion) | 13.8 parts |
| Solution C (sensitizer dispersion) | 36.0 parts |
| Carboxyl modified polyvinyl alcohol (PVA-KL318 manufactured by Kuraray Co., Ltd.), 10% aqueous solution | 25 parts |
| Rice starch particles (Micropearl R manufactured by Shimada Kagaku Kogyo K.K., average particle size 4.9 μm, a transmission electron microscope photograph of the starch particles is shown in FIG. 1) 15% dispersion | 20.0 parts |

| [Thermosensitive recording layer coating solution 2] | |
|---|---|
| Solution A (color developing agent dispersion) | 36.0 parts |
| Solution B (dye dispersion) | 13.8 parts |
| Solution C (sensitizer dispersion) | 36.0 parts |
| Carboxyl modified polyvinyl alcohol (PVA-KL318 manufactured by Kuraray Co., Ltd.) 10% aqueous solution | 25 parts |
| Rice starch particles (BKK-401 manufactured by Bangkok Starch Co., average particle size 4 μm) 15% dispersion | 20.0 parts |

Figure 2:
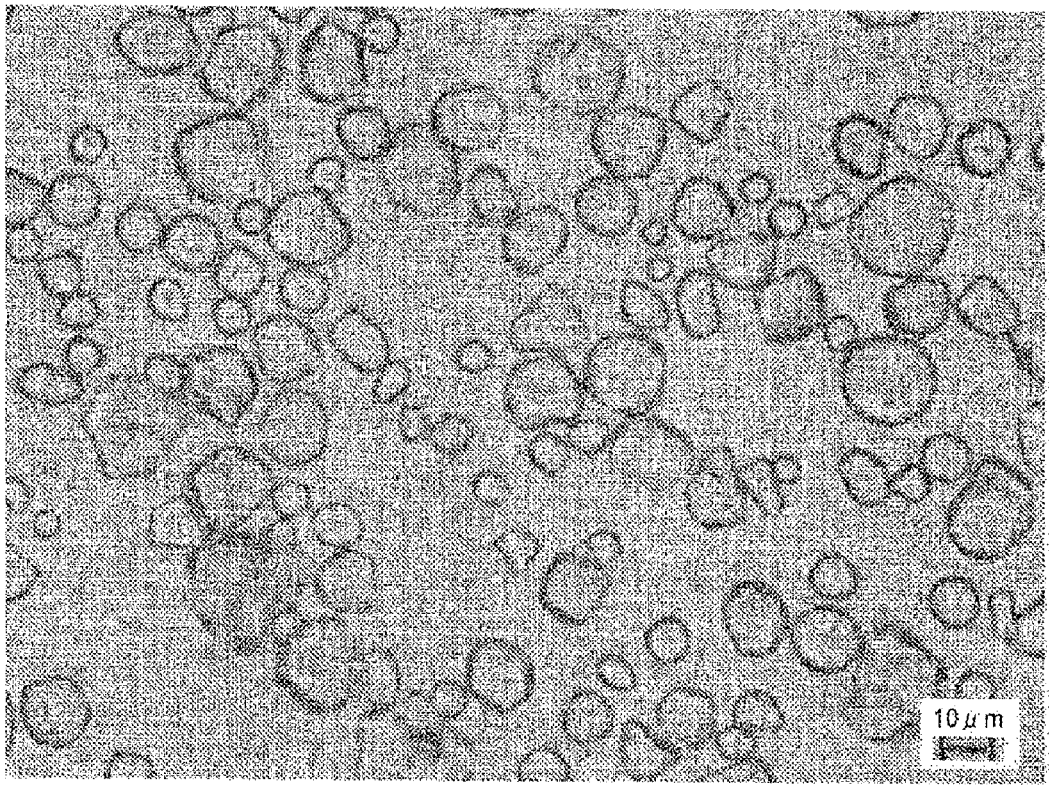
FIG. 2 shows a transmission electron microscope photograph of corn starch particles.

| [Thermosensitive recording layer coating solution 3] | |
|---|---|
| Solution A (color developing agent dispersion) | 36.0 parts |
| Solution B (dye dispersion) | 13.8 parts |
| Solution C (sensitizer dispersion) | 36.0 parts |
| Carboxyl modified polyvinyl alcohol (PVA-KL318) 10% aqueous solution | 25 parts |
| Corn starch particles (manufactured by Oji Corn Starch Co., average particle size 13 μm, a transmission electron microscope photograph of the starch particles is shown in FIG. 2) 15% dispersion | 20.0 parts |

| [Thermosensitive recording layer coating solution 4] | |
|---|---|
| Solution A (color developing agent dispersion) | 36.0 parts |
| Solution B (dye dispersion) | 13.8 parts |
| Solution C (sensitizer dispersion) | 36.0 parts |
| Carboxyl modified polyvinyl alcohol (PVA-KL318) 10% aqueous solution | 25 parts |
| Silica (Mizukasil P603 manufactured by Mizusawa Industrial Chemicals Ltd.), 30% dispersion | 10.0 parts |

Next the dispersions were blended in the proportions shown below to prepare coating solutions for protective layers. The temperature of the coating solutions during the blending operation was at most 30° C.

| [Protective Layer Coating Solution 1] | |
|---|---|
| Rice starch particles (Micropearl R manufactured by Shimada Kagaku Kogyo K.K.) 15% dispersion | 18.0 parts |
| Carboxyl modified polyvinyl alcohol (PVA-KL318) 10% aqueous solution | 30.0 parts |
| Zinc stearate (Hydrin Z-7-30 manufactured by Chukyo Yushi Co., Ltd., solid content 30%) | 2.0 parts |
| Polyamide epichlorohydrin resin (WS4020 manufactured by Seiko PMC Corporation., solid content 25%) | 2.0 parts |
| Modified polyamide resin (Sumirez Resin SP1106N) | 0.5 parts |

| [Protective Layer Coating Solution 2] | |
|---|---|
| Rice starch particles (BKK-402 manufactured by Bangkok Starch Co.) 15% dispersion | 18.0 parts |
| Carboxyl modified polyvinyl alcohol (PVA-KL318) 10% aqueous solution | 30.0 parts |
| Zinc stearate (Hydrin Z-7-30) | 2.0 parts |
| Polyamide epichlorohydrin resin (WS4020) | 2.0 parts |
| Modified polyamide resin (Sumirez Resin SP1106N) | 0.5 parts |

| [Protective Layer Coating Solution 3] | |
|---|---|
| Rice starch particles (BKK-402 manufactured by Bangkok Starch Co. average particle size 5-6 μm.) 15% dispersion | 18.0 parts |
| Carboxyl modified polyvinyl alcohol (PVA-KL318) 10% aqueous solution | 30.0 parts |
| Zinc stearate (Hydrin Z-7-30) | 2.0 parts |
| Polyamide epichlorohydrin resin (WS4020) | 2.0 parts |
| Modified polyamide resin (Sumirez Resin SP1106N) | 0.5 parts |

| [Protective Layer Coating Solution 4] | |
|---|---|
| Corn starch particles (manufactured by Oji Corn Starch Co. average particle size 13 μm.) 15% dispersion | 18.0 parts |
| Carboxyl modified polyvinyl alcohol (PVA-KL318) 10% aqueous solution | 30.0 parts |
| Zinc stearate (Hydrin Z-7-30) | 2.0 parts |
| Polyamide epichlorohydrin resin (WS4020) | 2.0 parts |
| Modified polyamide resin (Sumirez Resin SP1106N) | 0.5 parts |

Figure 3:
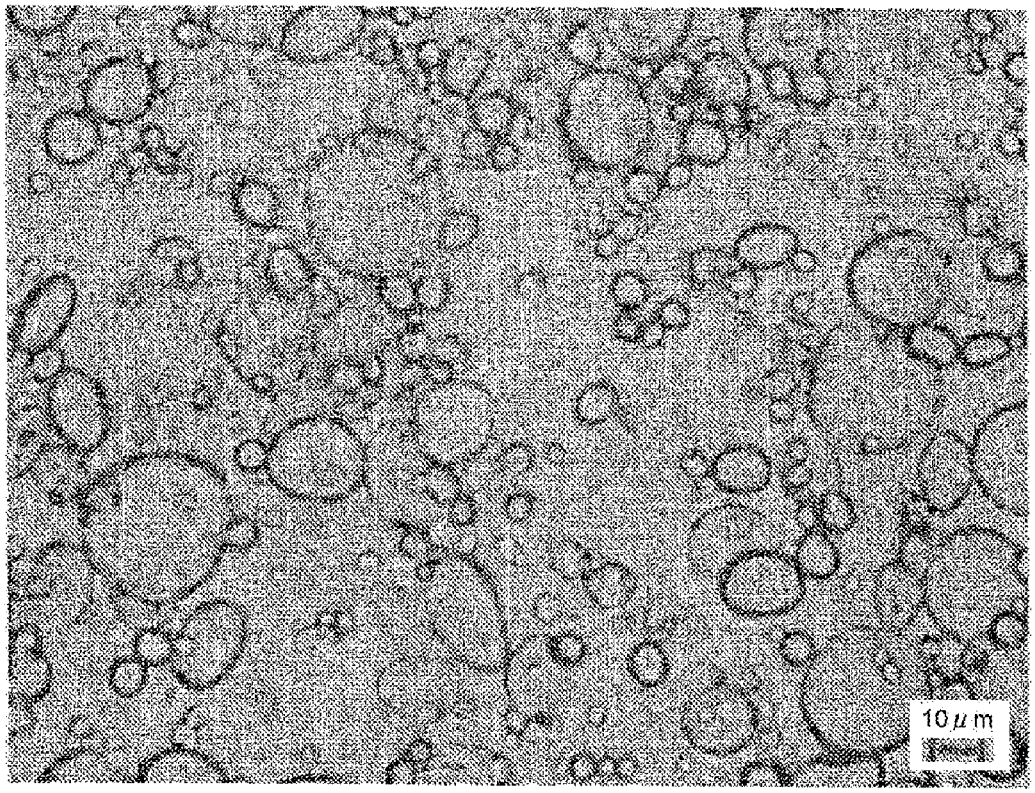
FIG. 3 shows a transmission electron microscope photograph of wheat starch particles.

| [Protective Layer Coating Solution 5] | |
|---|---|
| Wheat starch particles (manufactured by Nagata Sangyo K.K., average particle size 15 μm, a transmission electron microscope photograph of the starch particles is shown in FIG. 3) 15% dispersion | 18.0 parts |
| Carboxyl modified polyvinyl alcohol (PVA-KL318) 10% aqueous solution | 30.0 parts |
| Zinc stearate (Hydrin Z-7-30) | 2.0 parts |
| Polyamide epichlorohydrin resin (WS4020) | 2.0 parts |
| Modified polyamide resin (Sumirez Resin SP1106N) | 0.5 parts |

Figure 4:
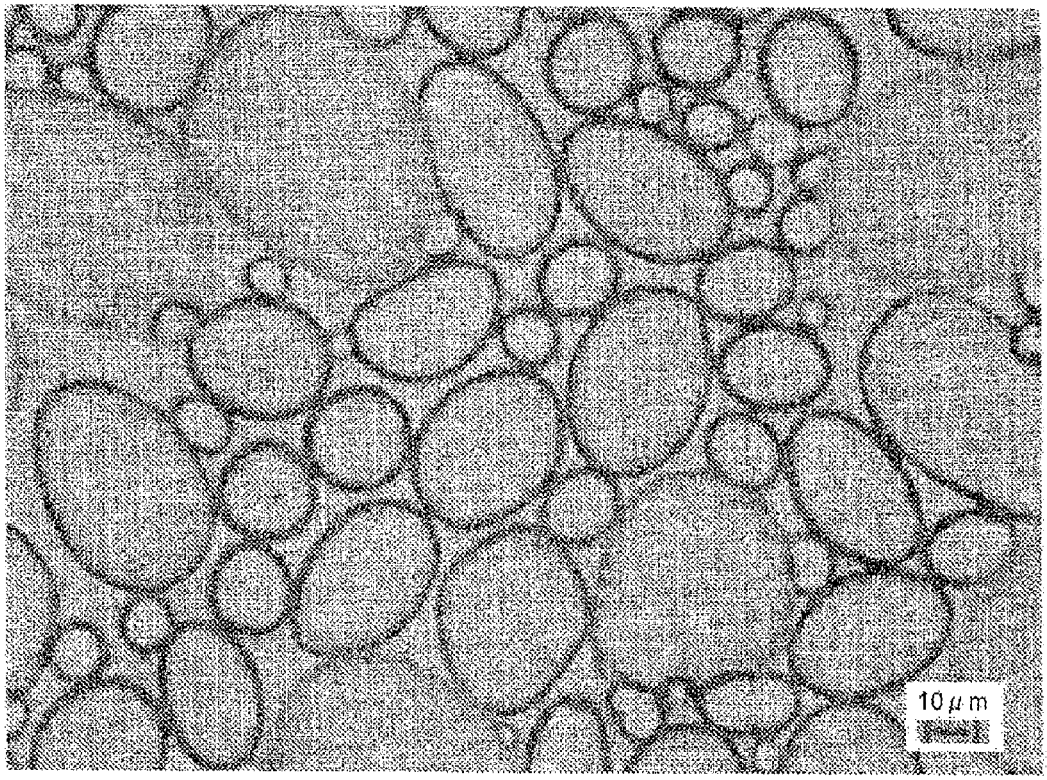
FIG. 4 shows a transmission electron microscope photograph of potato starch particles.

| [Protective Layer Coating Solution 6] | |
|---|---|
| Potato starch particles (manufactured by Hokuren, average particle size 35 μm, a transmission electron microscope photograph of the starch particles is shown in FIG. 4) 15% dispersion | 18.0 parts |

-continued

| [Protective Layer Coating Solution 6] | |
|---|---|
| Carboxyl modified polyvinyl alcohol (PVA-KL318) 10% aqueous solution | 30.0 parts |
| Zinc stearate (Hydrin Z-7-30) | 2.0 parts |
| Polyamide epichlorohydrin resin (WS4020) | 2.0 parts |
| Modified polyamide resin (Sumirez Resin SP1106N) | 0.5 parts |

| [Protective Layer Coating Solution 7] | |
|---|---|
| Sweet potato starch particles (manufactured by Seinan Sweet Potato Starch Co. average particle size 11 μm) 15% dispersion | 18.0 parts |
| Carboxyl modified polyvinyl alcohol (PVA-KL318) 10% aqueous solution | 30.0 parts |
| Zinc stearate (Hydrin Z-7-30) | 2.0 parts |
| Polyamide epichlorohydrin resin (WS4020) | 2.0 parts |
| Modified polyamide resin (Sumirez Resin SP1106N) | 0.5 parts |

| [Protective Layer Coating Solution 8] | |
|---|---|
| Aluminum hydroxide 30% dispersion (Martifin OL manufactured by Martinsburg Co. average particle size 5 μm) | 9.0 parts |
| Carboxyl modified polyvinyl alcohol (PVA-KL318) 10% aqueous solution | 30.0 parts |
| Zinc stearate (Hydrin Z-7-30) | 2.0 parts |
| Polyamide epichlorohydrin resin (WS4020) | 2.0 parts |
| Modified polyamide resin (Sumirez Resin SP1106N) | 0.5 parts |

[Protective Layer Coating Solution 9]

A 15% dispersion of rice starch particles (BKK-401 manufactured by Bangkok Starch Co.) was heated for 10 minutes at 95° C. and was used in place of the rice starch particles. A coating solution was prepared according to the same recipe described for protective layer coating solution 2.

Example 1

An undercoated paper with a coating amount of 10.0 g/m$^2$ was obtained by applying the undercoating layer coating solution on one side of a support material (a 60 g/m$^2$ substrate paper) and drying it.

Next the thermosensitive recording layer coating solution 1 was applied to the undercoating layer of the undercoated paper at a coating amount of 5.0 g/m$^2$ and was dried to yield a thermosensitive recording medium.

Example 2

A thermosensitive recording medium was prepared in the same manner described in Example 1 with the exception that the thermosensitive recording layer coating solution 2 was used in place of the thermosensitive recording layer coating solution 1.

Example 3

An undercoated paper with a coating amount of 10.0 g/m$^2$ was obtained by applying an undercoating layer coating solution on one side of a support material (a 60 g/m$^2$ substrate paper) and drying it.

Next the thermosensitive recording layer coating solution 4 was applied to the undercoating layer of the undercoated paper at a coating amount of 6.0 g/m$^2$ and was dried to yield a thermosensitive recording layer coated paper.

Next the protective layer coating solution 1 was applied to the thermosensitive recording layer of the thermosensitive recording layer coated paper at a coating amount of 3.0 g/m$^2$ and was dried to prepare a thermosensitive recording medium.

Example 4

A thermosensitive recording medium was prepared in the same manner described in Example 3 with the exception of using the protective layer coating solution 2 in place of the protective coating solution 1.

Example 5

A thermosensitive recording medium was prepared in the same manner described in Example 4 with the exception of changing the amount of the rice starch particles added using the protective layer coating solution 2 to 30 parts.

Example 6

A thermosensitive recording medium was prepared in the same manner described in Example 4 with the exception of changing the amount of the rice starch particles added using the protective layer coating solution 2 to 10 parts.

Example 7

A thermosensitive recording medium was prepared in the same manner described in Example 3 with the exception of using the protective layer coating solution 3 in place of the protective coating solution 1.

Example 8

A thermosensitive recording medium was prepared in the same manner described in Example 3 with the exception of using the thermosensitive recording layer coating solution 2 in place of the protective coating solution 4 and the protective layer coating solution 2 in place of the protective layer coating solution 1.

Comparative Example 1

A thermosensitive recording medium was prepared in the same manner described in Example 1 with the exception of using the thermosensitive recording layer coating solution 3 in place of the thermosensitive recording layer coating solution 1.

Comparative Example 2

A thermosensitive recording medium was prepared in the same manner described in Example 3 with the exception of using the protective layer coating solution 4 in place of the protective layer coating solution 1.

Comparative Example 3

A thermosensitive recording medium was prepared in the same manner described in Example 3 with the exception of using the protective layer coating solution 5 in place of the protective layer coating solution 1.

Comparative Example 4

A thermosensitive recording medium was prepared in the same manner described in Example 3 with the exception of using the protective layer coating solution 6 in place of the protective layer coating solution 1.

Comparative Example 5

A thermosensitive recording medium was prepared in the same manner described in Example 3 with the exception of using the protective layer coating solution 7 in place of the protective layer coating solution 1.

Comparative Example 6

A thermosensitive recording medium was prepared in the same manner described in Example 3 with the exception of using the protective layer coating solution 8 in place of the protective layer coating solution 1.

Comparative Example 7

A thermosensitive recording medium was prepared in the same manner described in Example 3 with the exception of using the protective layer coating solution 9 in place of the protective layer coating solution 1.

The thermosensitive recording media obtained in the manners described above were evaluated as follows.

<Color Development Sensitivity Evaluation>

The prepared thermosensitive recording medium were printed by a printing tester for thermosensitive recording paper (Ohkura Engineering Co. LTD., TBI-PMD equipped with a thermal head by Kyosera Co.) at recording energy of 0.27 mJ/dot. The Density of the printed image was measured and evaluated by using Macbeth Densitometer (RD-914).

<Image Quality Eevaluation>

A solidly printed area was visually evaluated.

Good: Area printed solidly in black was intense

Poor: Entire area solidly printed black looked faded

<Stamping Evaluation>

Stamp was printed on the prepared thermosensitive recording medium blank sheet, wiped off by a tissue paper at 5 sec after stamping and evaluated by naked eyes.

Good: The stamped letter remains on the sheet with slight grazing and can be read Fair: The stamped letter is grazed but can be read Poor: The stamped letter is grazed and can not be read <Scratching Evaluation>

A coated surface was scratched with steel wool under an added load of 1,000 g/cm$^2$ and the development of color lines was visually evaluated.

Good: Almost no color development

Fair: Pale color development

Poor: Heavy color development

<Printability Evaluation>

A Fogra type printability tester (NST-430 manufactured by Mitsui Electric Co., Ltd.) was used, tests were conducted under the following conditions:

| | |
|---|---|
| Dampening water unit pressure: | 20 kgf/cm$^2$ |
| Printing pressure: | 50 kgf/cm$^2$ |
| Dampening water (10% isopropyl alcohol): | 15 μl |
| Printing speed: | 100 to 180 m/min |
| Ink used: | UV foam FLASH DRY FD foam TF C71 pale green resistance NC M (tack index: 8.5 manufactured by Toyo Ink Seizo K.K.) |

Evaluation was conducted visually.

Good: Almost no ink removal

Fair: Slight ink removal was observed

Poor: Frequent ink removal was observed

<Wet Blocking Resistance Evaluation>

A total of 10 μl of tap water was dropped on a coated surface of a white paper sample. Then a white paper sample was stacked on top so that the coated surface was in contact with the wet surface. The coated layer was evaluated for peeling after the stacked sample was left standing for 24 hours at room temperature under added pressure of 10 g/cm$^2$.

Good: Almost no peeling of the coating layer

Fair: Slight peeling of the coating layer

Poor: Majority of the coating layer peeled

The evaluation results are shown in Table 1.

TABLE 1

| | Color development sensitivity | Image quality | Stamping | Scratching | Printability | Wet blocking resistance |
|---|---|---|---|---|---|---|
| Example 1 | 1.50 | Good | Good | Good | Good | Good |
| Example 2 | 1.48 | Good | Good | Good | Good | Good |
| Example 3 | 1.40 | Good | Good | Good | Good | Good |
| Example 4 | 1.47 | Good | Good | Good | Good | Good |
| Example 5 | 1.50 | Good~Fair | Good | Good~Fair | Good~Fair | Good |
| Example 6 | 1.43 | Good | Good~Fair | Good | Good | Good |
| Example 7 | 1.45 | Good | Good | Good | Good | Good |
| Example 8 | 1.48 | Good | Good | Good | Good | Good |
| Comparative Example 1 | 1.45 | Poor | Good | Good | Good | Good |
| Comparative Example 2 | 1.45 | Poor | Good | Good | Good | Good |
| Comparative Example 3 | 1.35 | Good | Fair | Poor | Fair | Poor |
| Comparative Example 4 | 1.26 | Poor | Good | Poor | Good | Poor |
| Comparative Example 5 | 1.34 | Fair | Fair | Poor | Fair | Poor |
| Comparative Example 6 | 1.41 | Good | Good | Poor | Fair | Fair |
| Comparative Example 7 | 1.38 | Poor | Fair | Poor | Poor | Poor |

The data demonstrated that sufficient color development sensitivity was obtained when rice starch particles are present in the outermost layer of the coating layers installed on a thermosensitive recording medium, and a thermosensitive recording medium with good stamping and anti-scratching properties, printability (blanket fouling and ink fixability) and wet blocking resistance can be obtained.

What is claimed is:

1. A thermosensitive recording medium having at least a thermosensitive recording layer as a coating layer on a substrate, wherein the thermosensitive recording layer comprises a colorless or pale colored basic leuco dye and an electron accepting developing agent, wherein at least the outermost layer of the thermosensitive recording medium contains non-gelatinized rice starch particles.

2. The thermosensitive recording medium of claim 1, wherein the outermost layer is a thermosensitive recording layer.

3. The thermosensitive recording medium of claim 1, wherein the thermosensitive recording medium has a protecting layer on the thermosensitive recording layer and the protecting layer is the outermost layer.

4. The thermosensitive recording medium of any one of claims 1 to 3, wherein the average particle size of the rice starch particles is from 2 μm to 7 μm.

5. A thermosensitive recording medium having at least a thermosensitive recording layer as a coating layer on a substrate, wherein the thermosensitive recording layer comprises a colorless or pale colored basic leuco dye and an electron accepting developing agent, wherein at least the outermost layer of the thermosensitive recording medium contains rice starch particles, wherein the rice starch particles are maintained below the gel gelatinization temperature of the rice starch particles during the preparation of the thermosensitive recording medium.

* * * * *